United States Patent [19]

Hoel et al.

[11] 4,090,560

[45] May 23, 1978

[54] JUNCTION HOUSING FOR USE IN UNDERSEA OIL WELLS

[75] Inventors: Eivin Hoel, Oslo; Svein Mathiassen, Kongsberg, both of Norway

[73] Assignee: A/S Akers Mek. Verksted, Oslo, Norway

[21] Appl. No.: 716,233

[22] Filed: Aug. 20, 1976

[30] Foreign Application Priority Data

Aug. 27, 1975 Norway ..... 752946

[51] Int. Cl.[2] ..... E21B 41/00

[52] U.S. Cl. ..... 166/.6; 61/86; 61/107; 61/110

[58] Field of Search ..... 61/86, 87, 105, 110, 61/112, 107; 166/.6, .5

[56] References Cited

U.S. PATENT DOCUMENTS

| | | | |
|---|---|---|---|
| 3,777,812 | 12/1973 | Burkhardt et al. | 166/.6 |
| 3,877,520 | 4/1975 | Putnam | 166/.6 |

*Primary Examiner*—Jacob Shapiro

*Attorney, Agent, or Firm*—Watson, Cole, Grindle & Watson

[57] ABSTRACT

A junction housing, which is removably positionable on the subsea floor, includes coupling halves for connection to complementary coupling halves of Christmas trees on subsea hydrocarbon wells, the coupling halves being connected by pipes and cables to separate coupling halves which are connectable to complementary coupling halves on a suitable riser.

15 Claims, 6 Drawing Figures

JUNCTION HOUSING FOR USE IN UNDERSEA OIL WELLS

BACKGROUND OF THE INVENTION

1. Field of the Invention

The invention relates to a junction housing for use in undersea oil wells.

2. Description of the Prior Art

Close to each hydrocarbon well is arranged a Christmas tree which comprises necessary valves and other equipment for controlling the well and which is connected to necessary connecting pipes and cables extending from a platform or other control base, depending on the method of production. These connecting pipes comprise production pipes which convey the produced hydrocarbons to the platform, connecting pipes extending from the platform to the annulus defined between the casing pipes and the production pipes, and pipes for transmitting hydraulic power for controlling valves, release mechanisms and other equipment, and electrical cables for connecting each Christmas tree to the platform for the transmission of signals to the hydraulically controlled devices, and the transmission of signals from measuring and other instruments and from the hydrocarbon wells.

These pipes may be subject to internal wear, which in the case of the production pipe may be caused to a great extent by sand or the like entrained in the hydrocarbons. Furthermore, the pipes are subject to corrosion damage and, in addition, both the pipes and cables may be damaged by water, foreign objects and so on.

A hydrocarbon source may have 30 or more wells with their associated Christmas trees, pipes and cables, and since hydrocarbon wells may be in production for fifteen to twenty years or more, it will be understood that the pipes and cables have to be raised to the platform at intervals for inspection, and repair or replacement of defective components. Similarly, the Christmas trees have to be raised to the platform at intervals for the same purposes.

Proposals for the raising of equipment from subsea well installations for inspection, repair and replacement have been made previously. These proposals are mainly designed for water depths where divers or frogmen may aid in the raising operation, and are thus limited to certain depths. At greater depths assistance may be rendered by manned submarine vessels equipped with manipulating tools, but these are dependent on considerable freedom of movement in the area where connection and disconnection and raising take place, for which reason the wells have to be spaced a substantial distance from each other.

It is clear that with the drilling and production techniques in use today and in prospect, operating at steadily increasing water depths and with increasing numbers of well heads drawing from one and the same hydrocarbon source, it is necessary to develop the capacity for pulling up or raising the pipes and cables to the platform for inspection, and repair and replacement of defective parts.

SUMMARY OF THE INVENTION

According to this invention there is provided a junction housing for pipes and cables for connecting a plurality of Christmas trees on subsea hydrocarbon wells to a coupling part for a riser, which junction housing has an enclosing configuration and has in one or more side walls thereof coupling halves for connection to complementary coupling halves on the respective Christmas trees, pipes and cables extending from the coupling halves in the side walls to coupling elements which are arranged for co-operation with complementary coupling elements in the riser coupling part.

In practical applications of the invention, the junction housing constitutes a common module housing the internal pipes and cable connection to a riser unit for a plurality of well installations. This module may be disconnected from the respective well head valve heads or Christmas trees by remote control from a platform or the like and, after removal of the riser, may be raised for instance to a platform deck for inspection, repair, replacement of defective parts, or possibly for replacement of the entire module with a corresponding new module which can be lowered to the well installation and connected to the associated Christmas trees.

Stopping and starting of production of the respective oil wells can be initiated in the usual way via remotely-controlled valves arranged on the Christmas trees. Disconnection and connection of the module may take place by means of remotely controlled, preferably hydraulically controlled, split couplings. This is obtained by arranging all the Christmas trees of the production wells on a permanent base, preferably in parallel rows, with for example five Christmas trees in each row, and by disposing a module between two such parallel rows in which module the pipes and cables may be detachably arranged. The module is preferably in permanently open communication with the surrounding water body for equalization of the hydrostatic pressure.

In the following description, the module is shown as being in the form of a parallelepipedic box or in a circular configuration wherein all pipes and cables are lockably mounted for servicing a hydrocarbon source with a plurality of wells arranged either in parallel rows or in a circular row, but the module may be in other forms depending on how the wells are arranged. For example, the wells may be in multiple concentric circles.

DESCRIPTION OF THE DRAWINGS

For further description of the invention, reference is made to the drawings where an installation according to the invention is shown diagrammatically. In the drawings

DESCRIPTION OF THE PREFERRED EMBODIMENTS

Figure 1:
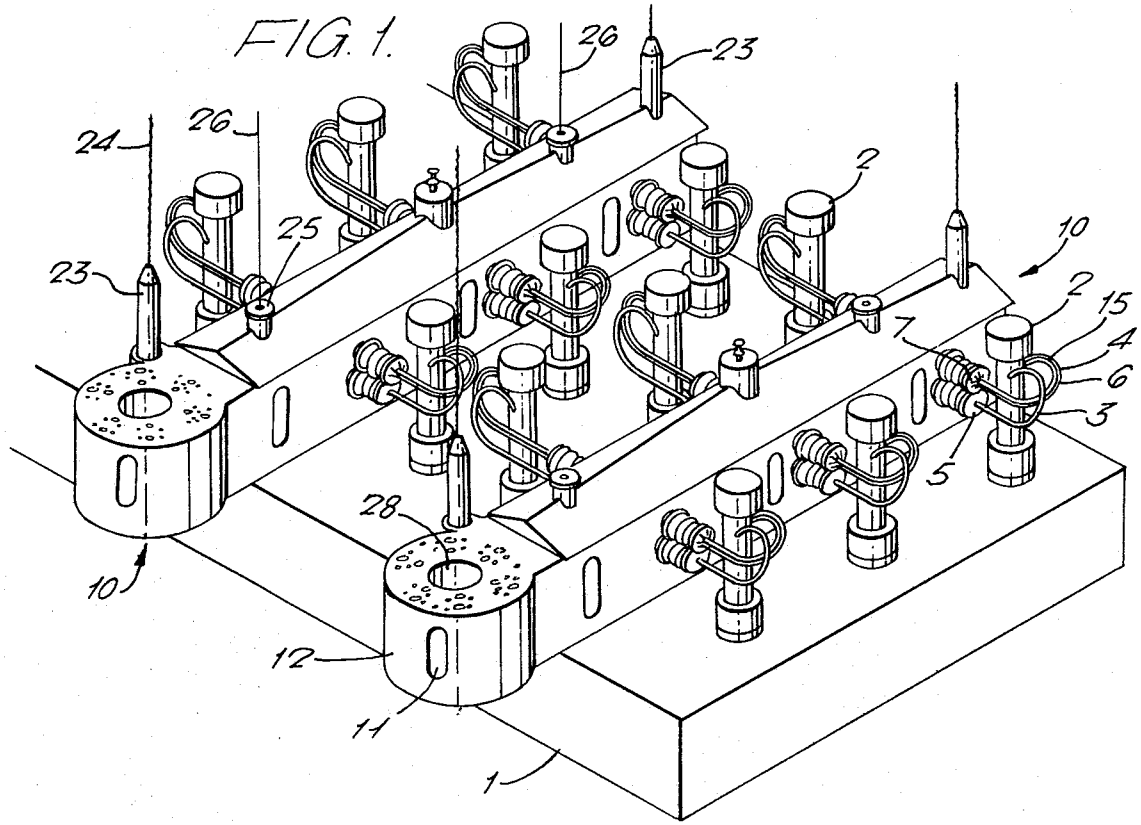
FIG. 1 shows an installation according to the invention arranged on a foundation.

FIG. 1 shows a foundation structure 1 arranged on the sea floor. The foundation may be of such a size that its own weight is sufficient for holding it in place on the sea floor prior to commencement of drilling of the wells through holes arranged in the foundation for the respective wells (not shown). The foundation may futhermore be attached to the sea floor by means of piles or the like. In general, it is preferably that the foundation 1 should have a rectangular form as shown and also for the wells to be arranged in two or a higher even number of parallel rows in order to permit the highest possible number of wells in a given area. Above each well pipe a valve tree 2 is arranged in lockable relation with the valve pipe in a known manner, the valves and other equipment of the valve tree being omitted from the drawing for the sake of clarity. For the same reason, there are shown only delivery pipes 3 for produced hydrocarbons, connecting pipes 15 for the annulus, hydraulic pipes 4 and electrical cables 6. Depending on the production method, in addition to the above-mentioned pipes, there may be provided pipes for the supply of gas under pressure for increasing the well capacity, pipes conveying hydrocarbons from different layers or depths, two or more in number, and various other lines.

The production pipe 3 is run in a loop or curve from the christmas tree 2 to a coupling half 5. The loop or curve has the effect that the coupling half is flexibly supported to a certain extent in relation to the Christmas tree so that any small movements between the junction housing and the Christmas tree will not damage the couplings or the other components. However, the flexibility is limited so that the coupling half 5, when it is not subjected to external loads, retains its position so that it can be easily coupled with coupling half 8.

The pipe 15 constitutes the connection to the annulus between the production pipe and the inner casing pipe in the well (not shown) and is likewise run in an arc from the Christmas tree to the coupling half 7 for the pipe 15, hydraulic pipe 4 and cables 6. The coupling halves 5 and 7 are arranged in the same position on all Christmas trees, and these are arranged in the same position on the well heads. Thus any Christmas tree may be arranged on any well head while maintaining uniform positioning of the coupling halves for connection with the corresponding coupling halves on the module, which will now be described.

The module or junction housing 10 is a header for all pipes leading from the Christmas trees 2, six in number in the example shown, to a collection point, from where they continue to a surface platform. The number of wells that can be connected to a junction housing is not limited to six, but may be higher or lower depending on how the wells can most suitably be arranged. The junction housing shown in FIGS. 1 to 4 and 6 has an elongated parallelopipedic form, but the form can be varied according to the pattern of drilling of the wells, for instance it may be circular with suitable numbers of wells in sections of the circle as shown in FIG. 5.

The elongate form shown in FIGS. 1 to 4 and 6 is a preferred arrangement for connection to two rows of wells or Christmas trees, the distance between the coupling halves on the Christmas trees in the two rows corresponds to the distance between the two rows of coupling halves on the junction housing.

Figure 2:
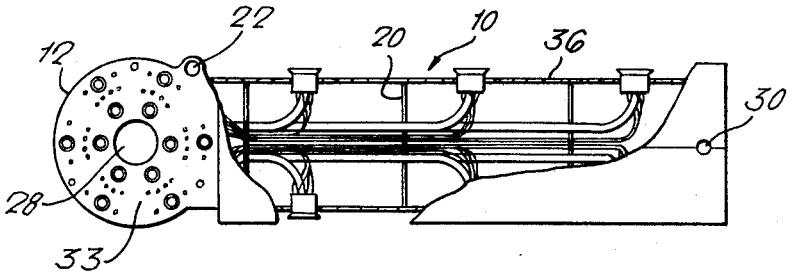
FIGS. 2 and 3 respectively show plan and side views, partly in cutaway, of one of the junction housings of the structure of FIG. 1.

FIG. 2 shows a junction housing 10 constructed from plate, this being a preferred arrangement. The junction housing is preferably generally open at the bottom and has openings 11 in its side walls so that the housing is filled with water for equalization of the hydrostatic pressure when situated below the water surface.

In an alternative embodiment the junction housing is of open truss construction. One end section 12 of the housing is of cylindrical form and constitutes a coupling part to which all pipes and cables are run and arranged in a circular pattern around a pipe extending through the housing and constituting a guide 28 for a pipe (not shown) conveying treated hydrocarbons from the platform down to the sea floor for further transport through a pipeline to the shore, or for connection to a storage tank or a floating loading buoy. In those cases where hydrocarbons are not transported back to the sea floor the guide 28 may constitute a guide for a stiff pipe or riser (not shown) for reinforcing pipes and cables leading from the coupling half 12 to the platform.

Figure 3:
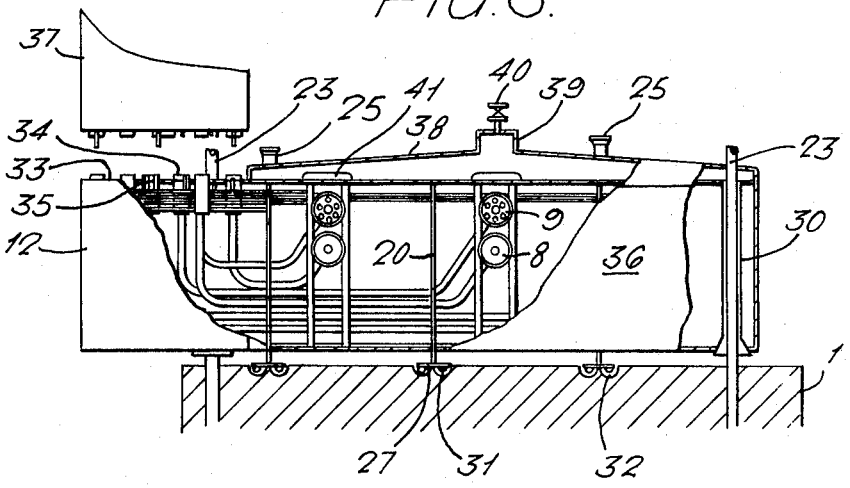
Figure 4:
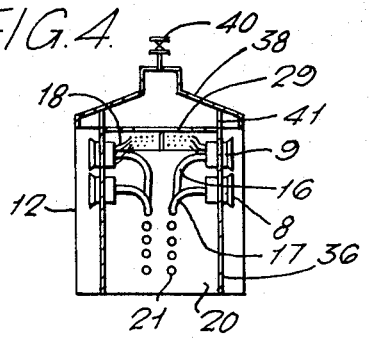
FIG. 4 shows a junction housing as shown in FIG. 1 in cross section.
Figure 5:
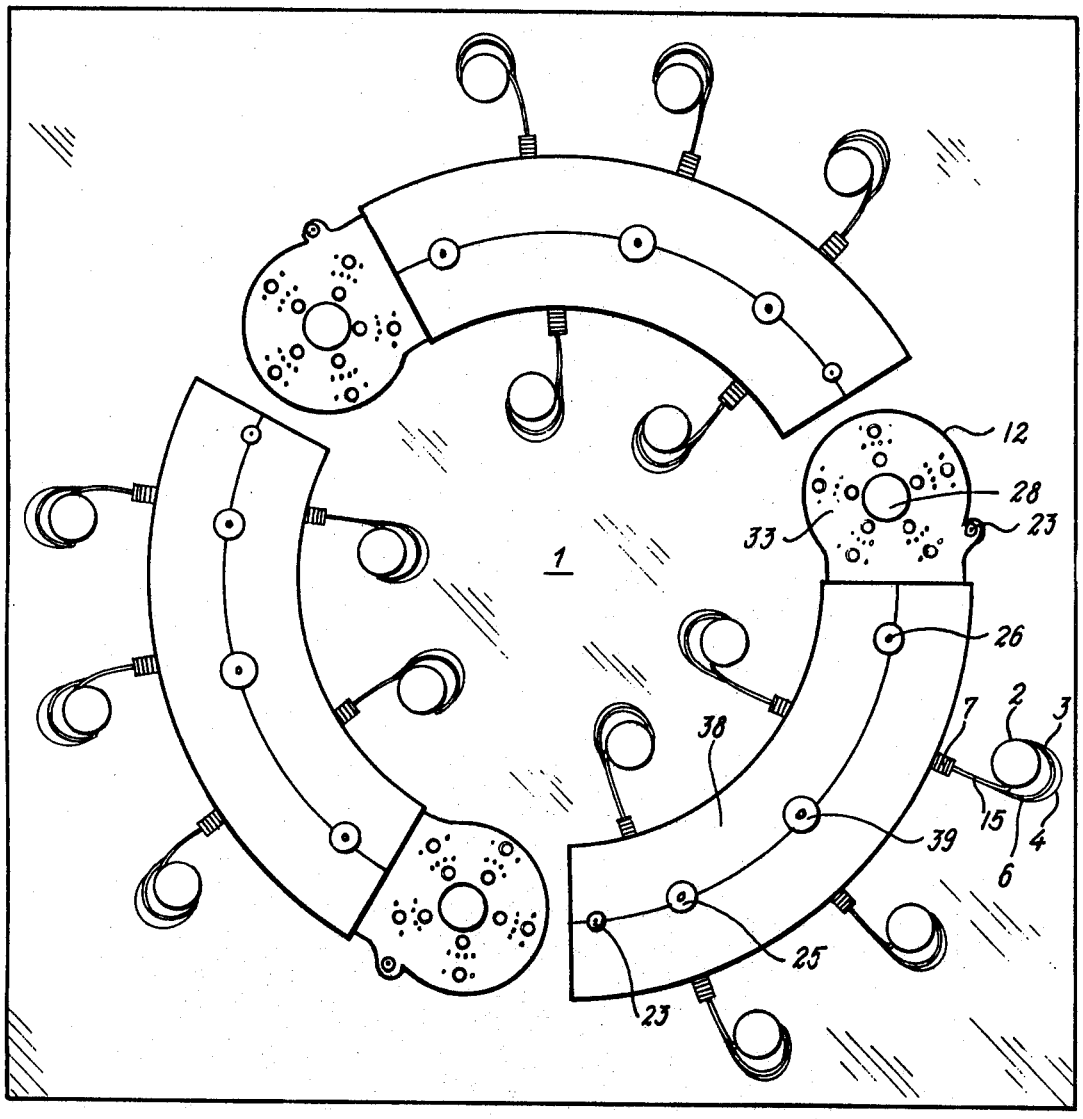
FIG. 5 shows a junction housing according to the invention which is in multiple sections, the sections together forming a cylindrical configuration.

From FIGS. 2, 3 and 4 it can be seen how all pipes and cables from the Christmas trees are built into the housing 10 to form a unit which can be raised to the platform by means of cables attached to automatic couplings 25 arranged on the top part of the housing. A through-pipe 30 is preferably arranged in the narrow end section of the housing and constitutes a guide for a guide wire 24 during raising and lowering of the junction housing, in addition to forming a guide for a guide bolt 23 attached to the foundation 1. The guide bolt comes into operation when the housing is approaching the foundation during lowering and remains in operation while the housing rests on the foundation.

In the coupling part 12 there is also arranged a through-pipe 22 having the same function as described for the pipe 30. A greater number of guides may be used as necessary or desirable.

The housing 10 is preferably not fixed on the foundation 1 since the coupled connections of the Christmas trees hold the housing in place. The housing rests on foundation brackets 27 fixed to the bottom side of the housing and preferably equipped with guide pins 31 co-operating with guide grooves 32 in the upper part of the foundation 1.

The coupling part 12 preferably projects some distance beyond the foundation 1 as shown in FIG. 3 so that the pipe led through the guide pipe 28 may be led in a simple fashion down to the sea floor.

The arrangement of pipes and cables inside the housing will now be described in some detail.

The coupling half 5 for hydrocarbons on each Christmas tree 2 is complementary to a coupling half 8 which preferably is removably arranged in one of the side walls 36 of the housing, and each coupling half 7 is complementary to a coupling half 9 which is also preferably removably arranged in the same side wall. The coupling halves 8 and 9 are positioned correspondingly to the coupling halves 5 and 7 for exact locking together.

A hydrocarbon pipe 17 is led from the coupling 8 inside the housing 10 to the top plate 33 of the coupling part 12 where it is connected to another coupling half 34 which is removably arranged in the top plate 33. The pipe 16 from the annulus is likewise led to the top plate 33 and is connected to another coupling half 35. All pipe bends for the pipe 17 extend in arc 1 of relatively large curvature so that tools and the like may be transported through the pipes to the desired location in the well. All pipes are suitably supported inside the housing and preferably in such a way that each pipe can be removed quickly from the housing for replacement.

Hydraulic pipes 18 are preferably run together from the couplings 9 to the top section 29 of the coupling part 12 where they are connected with respective coupling halves 35, which are preferably common for annulus pipes, hydraulic pipes and cables. Likewise, cables for the respective couplings 9 are run together to the couplings 35.

The top plate 33 of the coupling part 12 thus comprises couplings for all pipes and cables and these couplings co-operate with corresponding couplings arranged in complementary arrangement in a coupling part on the riser 37.

Figure 6:
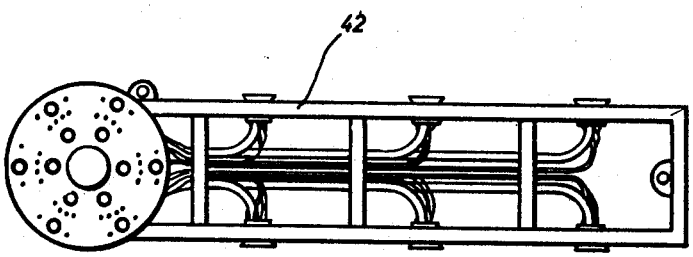
FIG. 6 shows a plan view of one of the junction housings of the structure of FIG. 1, similar to the view of FIG. 2, but wherein the housing is open at the top.

The upper section of the junction housing is formed like an upside-down (inverted) tray 38 which is in permanently open communication with the inside of the housing so that any leaking hydrocarbons can rise to a top part of the tray in the form of an oil sump 39 wherein a hydrocarbon detector is arranged for signalling to the platform when leakages occur. The tray 38 extends out over the side walls 36 of the housing so that any leakage from the couplings are led through openings 41 to the oil sump. A remotely controlled ventilation valve 40 is arranged in the top section of the oil sump for ventilating the drip tray during the lowering operation. If oil leakage detection is not required, to simplify the device the tray 38 may be omitted, such that the housing is open at the top as indicated in FIG. 6, thus utilizing only a framework 42.

We claim:

1. A junction housing for pipes and cables which function to connect a plurality of Christmas trees on subsea hydrocarbon wells to the coupling part of a riser, said junction housing including:

side support means;

a plurality of coupling halves mounted on at least one of said side support means for connection to complementary coupling halves on respective Christmas trees;

pipes and cables connected at one end to each of said plurality of coupling halves and extending within said housing away from said coupling halves;

a plurality of coupling elements positioned in association with said junction housing, each of said plurality of coupling elements being connectable to complementary coupling elements in the coupling part of a riser, said pipes and cables being connected to at their other end to said coupling elements; and each of the pipes and cables from each one of said coupling halves being connected to a single one of said coupling elements.

2. The junction housing of claim 1 wherein said junction housing is comprised of two or more housing sections.

3. The junction housing of claim 2 wherein said junction housing sections are positioned in a generally cylindrical configuration.

4. The junction housing of claim 1 wherein said side support means comprises side support walls, wherein said junction housing includes end wall means, and wherein said side support walls and end wall means form a generally parallelopipedic configuration.

5. The junction housing of claim 4 wherein said side support walls include means for providing a permanently open communication between the interior of said junction housing and water surrounding said junction housing for hydrostatic pressure equalization.

6. The junction housing of claim 1 wherein said junction housing includes means for locating and fixing said junction housing with respect to a foundation on the subsea floor.

7. The junction housing of claim 1 wherein said junction housing includes an inverted tray for positioning over said side support means.

8. The junction housing of claim 1 wherein said side support means comprises walls of plate construction.

9. The junction housing of claim 1 wherein said junction housing is of truss construction.

10. The junction housing of claim 1 wherein means are provided for connection to means for lifting said junction housing up from the subsea floor.

11. The junction housing of claim 10, wherein said connection means are controllable for automatically connecting to or releasing from the lifting means.

12. The junction housing of claim 1 wherein said side support means comprises side support walls, wherein said junction housing includes end wall means, wherein said junction housing includes an inverted tray covering said side support means and said end wall means for collecting oil leaking from the coupling and pipes within said junction housing when positioned on the subsea floor.

13. The junction housing of claim 12 wherein one of said end wall means is cylindrical in form, wherein a top plate is positioned thereon, and wherein said coupling elements are attached to said top plate.

14. A supporting structure for pipes and cables which function to connect a plurality of Christmas trees on subsea hydrocarbon wells to a riser, said supporting structure being disconnectable from the Christmas trees and the riser for removal from beneath the sea and easy maintenance thereof, said supporting structure including:

first coupling halves mounted on said structure for connection to complementary second coupling halves on the respective Christmas trees, third coupling halves connected to said structure for connection to complementary fourth coupling halves on the riser, and pipes and cables extending inside said structure interconnecting said first coupling halves and said third coupling halves, each of said first coupling halves being interconnected with a single of said third coupling halves.

15. The supporting structure of claim 14 wherein said structure includes side walls, an end wall at one end thereof and a cylindrical end section at the other end thereof having a top plate, and wherein said third coupling halves are attached to said top plate.

* * * * *